United States Patent [19]

Roshen et al.

[11] Patent Number: 4,862,129

[45] Date of Patent: Aug. 29, 1989

[54] SINGLE-TURN PRIMARY AND SINGLE-TURN SECONDARY FLAT VOLTAGE TRANSFORMER

[75] Inventors: Waseem A. Roshen; David E. Turcotte; Dale F. Regelman, all of Tucson, Ariz.

[73] Assignee: ITT Corporation, New York, N.Y.

[21] Appl. No.: 188,247

[22] Filed: Apr. 29, 1988

[51] Int. Cl.[4] ..... H01F 27/08; H01F 27/24; H01F 27/28

[52] U.S. Cl. ..... 336/61; 336/184; 336/212; 336/219; 336/223

[58] Field of Search ..... 336/223, 172, 212, 219, 336/61, 184, 183, 221, 222, 174, 175

[56] References Cited

U.S. PATENT DOCUMENTS

| | | | |
|---|---|---|---|
| 1,793,213 | 2/1931 | Dowling | 336/160 X |
| 1,849,485 | 3/1932 | Gibbs et al. | 336/172 |
| 1,910,172 | 5/1933 | Kouyoumjian | 336/172 X |
| 2,078,688 | 4/1937 | Sauer | 336/172 X |
| 2,283,711 | 5/1942 | Welch, Jr. | 336/172 |
| 2,284,406 | 5/1942 | D'Entremont | 336/172 X |
| 2,450,973 | 10/1948 | Lingel | 336/172 |
| 2,598,617 | 5/1952 | Stimler | 336/160 |
| 2,869,112 | 1/1959 | Hunter | 340/174 |
| 3,222,626 | 12/1965 | Feinberg et al. | 336/211.9 X |
| 4,146,859 | 3/1979 | Quirke | 336/189 |
| 4,206,434 | 6/1980 | Hase | 336/172 X |

FOREIGN PATENT DOCUMENTS

| | | | |
|---|---|---|---|
| 669276 | 11/1929 | France | 336/172 |

*Primary Examiner*—Thomas J. Kozma
*Attorney, Agent, or Firm*—Thomas L. Peterson

[57] ABSTRACT

A low-profile, high-frequency power transformer is comprised of a plurality of insulated ferrite slabs formed in a stacked array. In one embodiment a pair of slots are defined through the stacked array of insulated slabs. A single-turn metallic ribbon conductor is then looped through each pair of slots to form a corresponding first and second loop which are coupled in a magnetic flux circuit with each other through the stack. The distance separating one pair of slots is unequal to the distance separating the other pair of slots so that the loops formed by the ribbons have a corresponding unequal cross section. Hence the ratio of the voltages on the ribbons is proportional to the ratio of the respective cross-sectional areas of the ribbon loops. In another embodiment, a third ribbon is added having a cross-sectional loop area equivalent to the second ribbon to provide symmetrical, single-turn output coils.

9 Claims, 1 Drawing Sheet

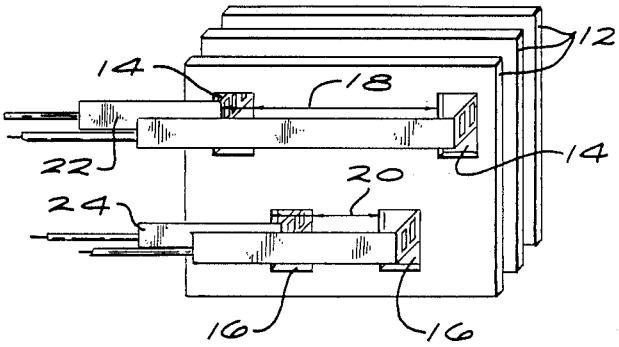
FIG. 1
FIG. 2
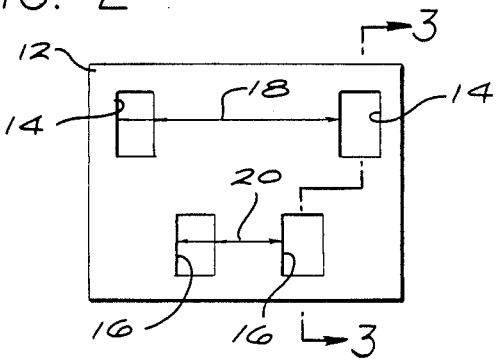
FIG. 3
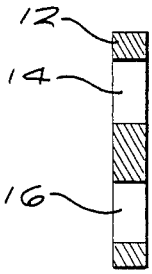
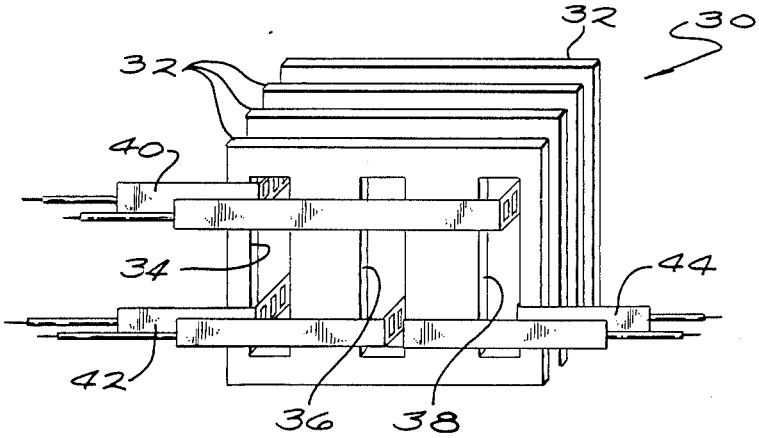
FIG. 4

SINGLE-TURN PRIMARY AND SINGLE-TURN SECONDARY FLAT VOLTAGE TRANSFORMER

BACKGROUND OF THE INVENTION

1. Field of the Invention

The invention relates to the field electrical discrete devices and in particular to flat transformers formed in slabs of ferrite material.

2. Description of the Prior Art

A classical transformer is comprised of a magnetic core of any one of a large variety of shapes around which is wound two or more coils. One of the coils is used as an input coil and is defined as the primary winding. The other coil is used as an output coil and is defined as the secondary winding. There may be in fact any combination of multiple input and output windings as desired in the application. Since the windings are wrapped around the same magnetic core, whatever its shape may be, the effective areas of cross section of the windings are approximately the same. Therefore, the voltage transformation which is achieved by the primary and secondary windings depends upon the ratio of their turns.

A number of problems arise in the situation of high frequency power applications. Typically the number of turns in the primary or secondary windings is such that high resistive losses are encountered. Although these losses can usually be accepted in low power low frequency applications, at higher frequency applications the physics of electrical conduction in the windings is qualitatively different in that skin effects and proximity effects preclude the efficient use of the total wire cross section. The resistive losses thus become exaggerated at high frequencies.

Moreover, because of the multiple number of turns in each of the windings on the transformer, it is difficult to manufacture a low profile or flat power transformer. The ability to manufacture a flat power transformer is particularly accentuated where multiple output coils are required on the transformer.

The prior art has devised a number of designs wherein multiple slabs of ferromagnetic material are utilized as the core structure for a transformer. Examples can be seen in HASE, "*Regulating Transformer with Magnetic Shunt*", U.S. Pat. No. 4,206,434 (1980); KOUYOUMJIAN, "*Electric Control Apparatus*", U.S. Pat. No. 1,910,172 (1933); STIMLER, "*Alternating Electric Current Transformer*", U.S. Pat. No. 2,598,617 (1952); and DOWLING, "*Electrical Translating Apparatus*", U.S. Pat. No. 1,793,312 (1931).

Although many of such prior art devices such as KOUYOUMJIAN and HASE may have aspect ratios which make them wider and taller than they are thick, they are not in reality extremely thin or flat transformers. Furthermore, the electrical transforming function which has been performed by each of these devices still depends upon the ratio of turns of the primary and secondary coils, and is thus subject to each of the high frequency defects discussed above.

Therefore, what is needed is a design for an electrical transformer which allows the transformer to be both extremely slim or flat and which can be utilized in high frequency applications without suffering the defects of prior art transformers.

BRIEF SUMMARY OF THE INVENTION

The invention is a transformer comprising at least one ferromagnetic planar slab. The slab has a first and second pair of slots defined therethrough. The slots of the first pair are separated from each other within the slab by a first corresponding predetermined distance. The slots of the second pair are separated from one another within the slab by a second predetermined distance. The first and second predetermined distances are unequal. A first conductive ribbon is disposed through the first pair of slots to form a first loop. The loop has one dimension approximately equal to the first predetermined distance. A second conductive ribbon is disposed through the second pair of slots and forms a second loop having at least one dimension approximately equal to the second predetermined distance. The first and second loops are magnetically coupled with each other through the slab to provide magnetic coupling between the loops with a voltage ratio between the loops approximately equal to the ratio of the first and second predetermined distances. As a result, the transformer presents a thin planar profile.

The transformer further comprises a plurality of the ferromagnetic planar slabs. Each slab has defined therethrough corresponding first and second pairs of slots. The first and second conductive ribbons are disposed through corresponding ones of the slots to form the corresponding first and second loops through all of the plurality of planar slabs.

In one embodiment each slab is a planar ferrite slab. In another embodiment each slab is an amorphous metal slab.

In the illustrated embodiment each slab is insulatively separated by an insulating layer having high thermal conductivity so that heat is readily conducted out of the plurality of slabs.

The first and second conductive ribbons form a single turn loop so that the thickness of the transformer is substantially determined by the planar slab.

In yet another embodiment the two pairs of slots are comprised of three slots, which are designated as a left slot, a middle slot which comprise the first pair of slots, and the middle slot and a right slot which comprise the second pair of slots. The first conductive ribbon is disposed through the left and right slots to form the first loop. The second conductive ribbon is disposed through the left and middle slots to form the the second loop. A third conductive ribbon is provided and disposed through the middle and right slots to form a corresponding third conductive loop. The third conductive loop is in magnetic circuit with the first conductive ribbon in an identical manner thereto as is the first and second conductive ribbons.

The transformer may further comprise a plurality of conductive ribbons selectively disposed through two of the left, middle and right slots to form a corresponding plurality of loops. Each loop is in magnetic circuit with the first loop in symmetrical relationship therewith as are the first and second loops formed by the first and second connective ribbons.

The invention can also be characterized as a flat, planar, high-frequency, lowloss power transformer comprising a plurality of planar slabs having a plurality of slots defined therethrough. The plurality of slots in each slab is aligned with an identical corresponding plurality of slots in each other one of the plurality of planar slabs. The planar slabs are composed of a material for providing a magnetic flux circuit. A plurality of flat sheet-like conductors are disposed through selected ones of the plurality of slots. Each conductor forms at least in part a loop through at least part of the plurality of planar slabs. Each of the corresponding loops of conductors is coupled in a magnetic flux circuit with each other. At least two of the loops define a cross-sectional area of a substantially circumscribed portion of the plurality of slabs. The corresponding cross-sectional areas of the at least two loops are unequal.

As a result, a thin, flat, low-profile transformer is provided which has minimal conductive losses through the plurality of conductors at high frequencies due to skin and proximity effect, and with minimal eddy current losses within the plurality of the planar slabs.

Each of the planar slabs is composed of ferrite material and wherein each the slabs is less than a fractional skin depth at the operative frequency thick so that eddy current losses within the plurality of slabs are minimized.

In one embodiment at least two of the plurality of flat sheet-like conductors form loops of substantially equal cross-sectional area and wherein a third one of the plurality of flat sheet-like conductors forms a corresponding loop of unequal cross-sectional area. The third one of the conductors is coupled in a magnetic flux circuit with the loop of the two sheet-like conductors, so that power transferred through the third conductor to the two conductors is substantially equally transformed between the loops of the two conductors.

The corresponding loops of each of the plurality of flat sheet-like conductors are formed by a single turn of the conductor.

The invention is still further characterized as a flat planar high-frequency power transformer comprising a plurality of flat, thin, planar, ferrite slabs. Each slab has a first pair of slots defined therethrough and a second pair of slots defined therethrough. The plurality of slabs are identically defined in each slab so as to be aligned when the slabs are stacked in an ordered array. A corresponding plurality of insulating layers are disposed between the plurality of ferrite slabs. Each insulating layer has an identical configuration to the slab with first and second pair of aligned slots defined therethrough. The plurality of ferrite slabs and insulating layers are sandwiched together in an alternating array to form a stack of insulated slabs with aligned pairs of the slots defined therethrough. Each insulating layer has high thermal conductivity to allow rapid transmission of heat away from aid stack. A first flat thin metallic ribbon conductor is disposed through a first one of the pair of slots defined through the stack of insulated ferrite slabs. The first insulated ribbon conductor forms at least in part a loop circumscribing a portion of the plurality of insulated ferrite slabs. This portion is characterized by a cross-sectional area of the corresponding first loop. A second insulated ribbon is disposed through the second pair of slots defined through the stack of insulated ferrite slabs. The second insulated ribbon forms at least in part a loop enclosing a portion of the stack of insulated ferrite slabs. The portion enclosed by the second insulated loop is characterized by a corresponding cross-sectional area. The cross-sectional area of the second loop is unequal to the corresponding cross-sectional area of the first loop. The first and second loops of the insulated ribbon conductor are coupled in a magnetic flux circuit through the insulated stack of ferrite slabs.

As a result, a low profile planar high-frequency power transformer is provided and is characterized by low eddy current losses within the ferrite stack and high thermal heat dissipation from the insulated stack.

The invention and its various embodiments can better be visualized by referring to the following drawings wherein like elements are referenced by like numerals.

BRIEF DESCRIPTION OF THE DRAWINGS

FIG. 1 is a diagrammatic perspective view of a first embodiment of the invention.

FIG. 2 is a plan view of one of the ferrite cores utilized in the embodiment shown in FIG. 1.

FIG. 3 is a sectional view taken through lines 3—3 of the ferrite slab of FIG. 2.

FIG. 4 is a diagrammatic perspective view of a second embodiment of the invention.

The invention and its various embodiments may be better understood by now turning to the following detailed description.

DETAILED DESCRIPTION OF THE PREFERRED EMBODIMENTS

A low-profile, high-frequency power transformer is comprised of a plurality of insulated ferrite slabs formed in a stacked array. In one embodiment a pair of slots are defined through the stacked array of insulated slabs. A single-turn metallic ribbon conductor is then looped through each pair of slots to form a corresponding first and second loop which are coupled in a magnetic flux circuit with each other through the stack. The distance separating one pair of slots is unequal to the distance separating the other pair of slots so that the loops formed by the ribbons have a corresponding unequal cross section. Hence the ratio of the voltages on the ribbons is proportional to the ratio of the respective cross-sectional areas of the ribbon loops. In another embodiment, a third ribbon is added having a cross-sectional loop area equivalent to the second ribbon to provide symmetrical, single-turn output coils.

A first embodiment of the present invention is shown in diagrammatic perspective view in FIG. 1, wherein one or more ferrite slabs, collectively denoted by reference numeral 10, are stacked one on top of the other or one behind the other to form a flat array. Each individual slab, denoted by reference numeral 12, is electrically insulated from the others either by the simple expedient of a gap as diagrammatically depicted in FIG. 1, or more preferably by a thin interlying layer of insulating material (not shown). The insulating material may a thin laminate or coating on each slab 12 with a high thermal conductivity to allow for improved thermal conduction away or heat sinking from the transformer. Suitable insulating layers include BeO and AIN in laminate form. Alternatively, slabs 12 may be comprised of amorphous metal sheets similarly insulated one from another.

At least two sets of slots 14 and 16 are defined through each of slabs 12. In the illustrated embodiment of FIG. 1, slots 14 are defined through the upper portion of each slab 12 and separated by a predetermined distance 18. Lower set of slots 16 are defined through the lower portion of slabs 12 as shown in FIG. 1 and separated by a predetermined distance 20. It is a feature of the invention that distances 18 and 20 are unequal.

In any case, sets of slots 14 and 16 are identically defined through each of the slabs 12 comprising the selective stack 10. In the illustrated embodiment, distance 18 is greater than distance 20 and in fact is twice as great. A first conductive ribbon 22 is provided as an input circuit or coil and is led through each of slots 14 on the left hand edges of slabs 12 as shown in FIG. 1, across the back of the rearmost slab 12 (not shown) and back through the rightmost slots 14 to form a return lead. Thus, ribbon 22 comprises a single loop through slots 14 in collection 10 of slab 12. Similarly, a second conductive lead 24 is similarly disposed through leftmost lower slot 16, through collection 10 of slab 12, across the back of rearmost slab 12 and outwardly through the rightmost slots 16 to form a return lead. Ribbon 24 thus forms a second conductive loop which is coupled through the magnetic circuit provided by collection 10 of slabs 12 with the loop formed by first ribbon 22. Ribbons 22 and 24 are fabricated from metallic sheet material typically 0.001-to-0.01" thick. In the preferred embodiment ribbons 22 and 24 are comprised of a metal such as copper. Although not depicted in the diagrammatic illustration of FIG. 1, ribbons 22 and 24 may also include insulative coatings, layers or coverings which prevent shorting across the loop formed by ribbons 22 and 24 or other stray conductions through collection 10 of slabs 12.

FIG. 2 is a plan top view of one of ferrite slabs 12 as shown in FIG. 1. FIG. 3 is a cross-sectional view taken through the bent section lines 3—3 of FIG. 2 so that a sectional view through each slot 14 and 16 is depicted. FIG. 1 illustrates graphically that in the case of a ribbon loop placed through slots 14 and 16, which have a significantly greater width than the thickness of the ribbon, that the distances 20 and 18 must be measured from corresponding sides of each of the respective slots. More particularly, in FIG. 2 distance 18 is measured from each of the left sides of slots 14 and 16, since ribbons 22 and 24 are led into and out of stack 10 from the left side and hence are pulled during fabrication to the left side of each slot. Clearly, the distances would be differently defined if other fabrication techniques were utilized, such as leading ribbons 22 and 24 in both from the right side or in from the left and out from the right, and vice versa.

Even though in the illustrated embodiment of FIG. 1 there is only a single loop formed by ribbons 22 and 24, the input-to-output voltage ratio is nevertheless two to one. This is due to the fact that the cross-sectional area encompassed within collection 10 of slabs 12 by the loop formed by ribbon 22 is twice as large as that formed by the loop of ribbon 24. This surprising result, that is the high voltage ratio despite a single loop, is obtained because the distance between top slots 14 is about twice the distance between bottom slots 16. The output-to-input voltage ratio can thus be varied to obtain even greater or lesser ratios depending upon the ratio of distances 18 and 20. Although the ratio is not infinitely expandable, it is expected that input-to-output voltage ratios of the order of magnitude of 5 can be practically obtained with a device constructed according to the teaching of FIG. 1.

The invention further has the advantage that input and output of ribbon connectors 22 and 24 are as stated, made from sheet conductors, in the illustrated embodiment, ribbons 0.2" wide and 0.003" thick. This minimizes conduction losses by reducing skin and proximity effects, and therefore creates greater current carrying capacity. For example, a conventional circular wire having the same cross-sectional area as that of a ribbon conductor 0.003" thick and 0.2" wide could be expected to have 300 percent higher losses.

Still further, the invention allows an inherently flat or planar structure. Not only is the collective stack or collection 10 of slabs 12 substantially thinner than conventional cores, the addition of ribbon conductors 22 and 24 add negligibly to the overall thickness of the transformer. However, no matter how thin the transformer becomes, the input-to-output voltage ratio is not significantly affected. In fact it is expected that there will no effect upon voltage transformation characteristics with transformers as thin as 0.05" utilizing one or more slabs 12.

Still further, the use of laminated ferrite for each slab 12 reduces eddy current losses within the ferrite material. These eddy current losses are very significant at high frequencies, amounting to as much as 50.80 percent energy loss at 500–1000 kHz. On the other hand, a device made according to the invention can 50 percent or more reduction in eddy current losses, utilizing 0.05 thick ferrite slabs.

In certain applications, there is a need to connect a multiple number of identical electronic circuits or loads in parallel in order to increase the overall power which can be delivered to the collective load. A single turn transformer, as described in connection with FIG. 1, offers a significant advantage in that, if such multiple load units are driven by the same transformer of the type as depicted and described below in connection with FIG. 4, the transformer design assures that the load is shared equally by each of the electronic circuits. Therefore, the load and electronic stress, such as heat dissipation and the like, placed on any one of the individual circuits, will be reduced and the overall reliability of the product maximized.

Turn now to FIG. 4 wherein a perspective view of a diagrammatic depiction of such a dual output, single turn transformer is shown, generally denoted by reference numeral 30. Transformer 30 similarly includes a plurality of ferrite slabs 32 of generally the same composition and arrangement as described above in connection with FIGS. 1–3. However, slabs 32 of FIG. 4 include a plurality of slots 34–38. In the illustrated embodiment slots 34–38 are all identical to slot 36 defined through the middle of each slab 32 with slot 34 on the left and slot 38 on the right as depicted in FIG. 4. A metallic input ribbon 40 is provided and disposed through leftmost slots 34 in slabs 32, across the back of the rearmost slab 32, and forwardly through the rightmost slots 38 of slabs to form a return lead.

However, transformer 30 includes two output conductors, namely ribbons 42 and 44. Output ribbon 42 is similarly disposed through leftmost slot 34 of each slab 32, across the back of the rearmost slab 32, but is then brought forwardly through center slot 36 in each of slabs 32 and outwardly to the left to form a return lead as depicted in FIG. 4. Similarly, output ribbon 44 is disposed through the rightmost slot 38 of each slab 32, across the back of the rearmost slab 32, and then forwardly through center slot 36 to form a return a lead to the right, as depicted in FIG. 4.

Transformer 30 is now provided with two symmetrical, single turn output loops, each having approximately one half the cross-sectional area of the input loop formed by ribbon 40. However, due to the symmetry of the output loops formed by ribbons 42 and 44, the power which is delivered to a first and second load coupled respectively to ribbons 42 and 44 is similarly symmetrical or equal.

It must be expressly understood that the embodiment of FIG. 4 may be extended to include even more output loops, odd or even in total number, which could be disposed in a similar manner through slots 34–38 either by forming one or more loops above those formed by ribbons 42 and 44 or by placing additional ribbons insulated one from the other on top of or concentrically within the loops depicted in FIG. 4 by ribbons 42 and 44.

Many alterations and modifications may be made by those having ordinary skill in the art without departing from the scope and spirit of the invention. Therefore, the illustrated embodiment must be taken as set forth simply for the purposes of clarity of explanation and not as a limitation of the invention as defined in the following claims.

I claim:

1. A transformer comprising at least one ferromagnetic planar slab, said slab having first and second pairs of slots defined therethrough, said slots of said first pair being separated from each other within said slab by a first corresponding predetermined distance, said slots of said second one of said pairs being separated from one another within said slab by a second predetermined distance, said first and second predetermined distances being unequal;

a first conductive ribbon disposed through said first pair of slots to form a first loop, said loop having one dimension approximately equal to said first predetermined distance; and a second conductive ribbon disposed through said second pair of slots and forming a second loop having at least one dimension approximately equal to said second predetermined distance, said first and second loops being magnetically coupled with each other through said slab for providing magnetic coupling between said loops with a voltage ratio between said loops approximately equal to the ratio of said first and second predetermined distances, further comprising a plurality of said ferromagnetic planar slabs, each slab having defined therethrough corresponding first and second pairs of slots, said first and second conductive ribbons disposed through corresponding ones of said slots to form said corresponding first and second loops through all of said plurality of planar slabs; and wherein each slab is insulatively separated by an insulating layer having high thermal conductivity so that heat is readily conducted out of said plurality of slabs, whereby said transformer presents a thin planar profile.

2. A transformer comprising at least one ferromagnetic planar slab, said slab having first and second pairs of slots defined therethrough, said slots of said first pair being separated from each other within said slab by a first corresponding predetermined distance, said slots of said second one of said pairs being separated from one another within said slab by a second predetermined distance, said first and second predetermined distances being unequal;

a first conductive ribbon disposed through said first pair of slots to form a first loop, said loop having one dimension approximately equal to said first predetermined distance; and a second conductive ribbon disposed through said second pair of slots and forming a second loop having at least one dimension approximately equal to said second predetermined distance, said first and second loops being magnetically coupled with each other through said slab for providing magnetic coupling between said loops with a voltage ratio between said loops approximately equal to the ratio of said first and second predetermined distances.

further comprising a plurality of said ferromagnetic planar slabs, each slab having defined therethrough corresponding first and second pairs of slots, said first and second conductive ribbons disposed through corresponding ones of said slots to form said corresponding first and second loops through all of said plurality of planar slabs.

wherein each slab is a planar ferrite slab; and wherein each slab is insulatively separated by an insulating layer having high thermal conductivity so that heat is readily conducted out of said plurality of slabs, whereby said transformer presents a thin planar profile.

3. A flat, planar, high-frequency, low-loss power transformer comprising:

a plurality of planar slabs, each slab having a plurality of slots defined therethrough, said plurality of slots in each slab aligned with said plurality of slots in each other one of said plurality of planar slabs, said planar slabs composed of a material for providing a magnetic flux circuit; and a plurality of flat sheet-like conductors disposed through selected ones of said plurality of slots, each conductor forming at least in part a loop through at least part of said plurality of planar slabs, each of said corresponding loops of conductors being coupled in a magnetic flux circuit with each other, at least two of said loops defining a cross-sectional area of a substantially circumscribed portion of said plurality of slabs, said corresponding cross-sectional areas of said at least two loops being unequal, and wherein each of said plurality of planar slabs is each electrically insulated from each other by an interlying insulating layer between each of said planar slabs, said interlying layer having a high thermal conductivity so that heat transfer out of said transformer is maximized, whereby a thin, flat, low-profile transformer is provided with minimal conductive losses through said plurality of conductors at high frequencies due to skin and proximity effect, and with minimal eddy current losses within said plurality of said planar slabs.

4. A flat, planar, high-frequency, low-loss power transformer comprising:

a plurality of planar slabs, each slab having a plurality of slots defined therethrough, said plurality of slots in each slab aligned with said plurality of slots in each other one of said plurality of planar slabs, said planar slabs composed of a material for providing a magnetic flux circuit; and a plurality of flat sheet-like conductors disposed through selected ones of said plurality of slots, each conductor forming at least in part a loop through at least part of said plurality of planar slabs, each of said corresponding loops of conductors being coupled in a magnetic flux circuit with each other, at least two of said loops defining a cross-sectional area of a substantially circumscribed portion of said plurality of slabs, said corresponding cross-sectional areas of said at least two loops being unequal, and wherein each of said planar slabs is composed of ferrite material and wherein the thickness of each said slab is less than a fractional skin depth at the operative frequency, so that eddy current losses within said plurality of slabs are minimized, whereby a thin, flat, low-profile transformer is provided with minimal conductive losses through said plurality of conductors at high frequencies due to skin and proximity effect, and with minimal eddy current losses within said plurality of said planar slabs.

5. A flat planar high-frequency power transformer comprising:

a plurality of flat, thin, planar, ferrite slabs, each slab having a first pair of slots defined therethrough and a second pair of slots defined therethrough, said corresponding first pair and second pairs of slots defined in siad plurality of slabs being identically defined in each slab so that said first and second pair of slots are aligned when said slabs are stacked in an ordered array the thickness of each of said slabs being less than a fractional skin depth at the operative frequency of said transformer, so that eddy current losses within said plurality of slabs are minimized;

a corresponding plurality of insulating layers disposed between said plurality of ferrite slabs, each insulating layer having an identical configuration to said slab with first and second pair of aligned slots defined therethrough, said plurality of ferrite slabs and insulating layers sandwiched together in an alternating array to form a stack of insulated slabs with aligned pairs of said slots defined therethrough, each insulating layer having high thermal conductivity to allow rapid transmission of heat away from said stack;

a first flat thin metallic ribbon conductor disposed through a first one of said pair of slots defined through said stack of insulated ferrite slabs, said first insulated ribbon conductor forming at least in part a loop circumscribing a portion of said plurality of insulated ferrite slabs, said portion being characterized by a cross-sectional area of said corresponding first loop; and a second insulated ribbon disposed through said second pair of slots defined through said stack of insulated ferrite slabs, said second insulated ribbon forming at least in part a loop enclosing a portion of said stack of insulated ferrite slabs, said portion enclosed by said second insulated loop being characterized by a corresponding cross-sectional area, said cross-sectional area of said second loop being unequal to said corresponding cross-sectional area of said loop, said first and second loops of said insulated ribbon conductor being coupled in a magnetic flux circuit through said insulated stack of ferrite slabs, whereby a low profile planar high-frequency power transformer is provided characterized by low eddy current losses within said ferrite stack and high thermal heat dissipation from said insulated stack.

6. A transformer comprising further comprising:

a plurality of ferromagnetic planar slabs, each said slab having first and second pairs of slots defined therethrough, said slots of said first pair being separated from each other within said slab by a first corresponding predetermined distance, said slots of said second one of said pairs being separated from one another within said slab by a second predetermined distance, said first and second predetermined distances being unequal;

a first conductive ribbon disposed through said first pair of slots in each slab to form a first loop, said loop having one dimension approximately equal to said first predetermined distance; and a second conductive ribbon disposed through said second pair of slots in each slab and forming a second loop having at least one dimension approximately equal to said second predetermined distance, said first and second loops being magnetically coupled with each other through said slab for providing magnetic coupling between said loops with a voltage ratio between said loops approximately equal to the ratio of said first and second predetermined distances, said first and second conductive ribbons being disposed through corresponding ones of said slots to form said corresponding first and second loops through all of said plurality of planar slabs, wherein each slab is insulatively separated by an insulating layer having high thermal conductivity so that heat is readily conducted out of said plurality of slabs.

7. A transformer comprising further comprising:

a plurality of amorphous metal slabs, each said slab having first and second pairs of slots defined therethrough, said slots of said first pair being separated from each other within said slab by a first corresponding predetermined distance, said slots of said second one of said pairs being separated from one another within said slab by a second predetermined distance, said first and second predetermined distances being unequal;

a first conductive ribbon disposed through said first pair of slots in each slab to form a first loop, said loop having one dimension approximately equal to said first predetermined distance; and a second conductive ribbon disposed through said second pair of slots in each slab and forming a second loop having at least one dimension approximately equal to said second predetermined distance, said first and second loops being magnetically coupled with each other through said slab for providing magnetic coupling between said loops with a voltage ratio between said loops approximately equal to the ratio of said first and second predetermined distances, said first and second conductive ribbons being disposed through corresponding ones of said slots to form said corresponding first and second loops through all of said plurality of planar slabs, wherein each slab is insulatively separated by an insulating layer having high thermal conductivity so that heat is readily conducted out of said plurality of slabs.

8. The transformer of claim 6 wherein said insulating layers are comprised of BeO and AIN in laminate form.

9. The transformer of claim 7 wherein said insulating layers are comprised of BeO and AIN in laminate form.

* * * * *

UNITED STATES PATENT OFFICE

CERTIFICATE OF CORRECTION

PATENT NO. : 4,862,129

DATED : August 29, 1989

INVENTOR(S) : Waseem A. Roshen; David E. Turcotte; Dale F. Regelman

It is certified that error appears in the above-identified patent and that said Letters Patent is hereby corrected as shown below:

Column 4, line 54, "AIN" should read --AlN--;

Column 10, line 65, "AIN" should read --AlN--; and

Column 10, line 67, "AIN" should read --AlN--.

Signed and Sealed this

Sixth Day of July, 1993

Michael K. Kirk

*Attest:*

MICHAEL K. KIRK

*Attesting Officer*

*Acting Commissioner of Patents and Trademarks*